US011849819B1

(12) United States Patent
Jameson et al.

(10) Patent No.: US 11,849,819 B1
(45) Date of Patent: Dec. 26, 2023

(54) KIT OF PARTS INCLUDING ELASTIC RING-BASED ORNAMENT MAKING DEVICE, ELASTIC RING, AND PLURALITY OF ORNAMENTAL MEMBERS

(71) Applicant: SPIN MASTER LTD., Toronto (CA)

(72) Inventors: Mollie B. Jameson, Toronto (CA); Graham D. Browning, Toronto (CA); Emma Peat, Toronto (CA); Matthew Lentini, Toronto (CA); Seiji Murakami, Kanagawa (JP)

(73) Assignee: SPIN MASTER LTD., Toronto (CA)

( * ) Notice: Subject to any disclaimer, the term of this patent is extended or adjusted under 35 U.S.C. 154(b) by 0 days.

(21) Appl. No.: 18/082,372

(22) Filed: Dec. 15, 2022

(51) Int. Cl.
*A44C 5/00* (2006.01)
*A44C 27/00* (2006.01)

(52) U.S. Cl.
CPC ..... *A44C 5/0084* (2013.01); *A44C 27/00* (2013.01)

(58) Field of Classification Search
CPC ... A44C 5/0084; A44C 27/00; Y10T 29/4959; Y10T 29/49588; Y10T 29/5363; Y10T 29/49591; B21F 45/00
USPC ..... 81/486, 3.7
See application file for complete search history.

(56) References Cited

U.S. PATENT DOCUMENTS 2,518,142 A * 8/1950 Huntington ..... B25B 27/12 29/229
3,681,840 A * 8/1972 Pool ..... B25B 27/205 29/229
5,887,448 A 3/1999 Gilbert et al.
6,880,364 B1 4/2005 Vidolin et al.
6,968,671 B2 11/2005 Dal Monte
6,983,522 B2 * 1/2006 Weller ..... B23B 31/201 29/268
D821,248 S 6/2018 Naqvi
10,287,718 B2 5/2019 Wright
10,702,031 B2 7/2020 Thomas
2002/0138963 A1 * 10/2002 Ramirez ..... B25B 27/205 29/451
2003/0192162 A1 * 10/2003 Ramirez ..... B25B 27/20 29/229

(Continued)

OTHER PUBLICATIONS

TTPM Toy Reviews, "My Image Bracelet Maker from Choose Friendship Company", Web page <https://www.youtube.com/watch?v=CWf5yvRqcJs>, Jan. 9, 2013, retrieved Jan. 18, 2023.

*Primary Examiner* — Jack W Lavinder
(74) *Attorney, Agent, or Firm* — Aird & McBurney LP

(57) ABSTRACT

In an aspect, there is provided an elastic ring-based ornament making device for constructing an elastic ring-based ornament that includes at least one elastic ring and a plurality of ornamental members positioned thereon. The elastic ring-based ornament making device includes an elastic ring support including a plurality of extension arms which are movable between retracted and extended positions. When the arms are retracted, the elastic ring support supports the at least one elastic ring in a first state. When the arms are extended, the elastic ring support supports the at least one elastic ring in a second state. The at least one elastic ring is stretched more in the second state than in the first state. The arms when extended are spaced from one another sufficiently to permit mounting of the ornamental members on the at least one elastic ring between the arms.

20 Claims, 7 Drawing Sheets

(56) References Cited

U.S. PATENT DOCUMENTS

| | | | | |
|---|---|---|---|---|
| 2008/0250815 | A1 | 10/2008 | Wachler et al. | |
| 2009/0031757 | A1 | 2/2009 | Harding | |
| 2013/0074545 | A1 | 3/2013 | Moloney | |
| 2013/0291957 | A1* | 11/2013 | Di | B23P 19/084 29/229 |

* cited by examiner

KIT OF PARTS INCLUDING ELASTIC RING-BASED ORNAMENT MAKING DEVICE, ELASTIC RING, AND PLURALITY OF ORNAMENTAL MEMBERS

The specification relates generally to transformable toys and more particularly to transformable toy that can be rolled when in a first state.

FIELD OF THE DISCLOSURE

The present disclosure relates to elastic ring-based ornaments and devices for making such ornaments.

BACKGROUND OF THE DISCLOSURE

It is known to construct crafts at home such as bracelets and other jewelry. It is also known to provide tools to assist in the construction of such crafts. There is, however, a continuing need to provide new types of jewelry, and new tools to assist in their construction.

SUMMARY OF THE DISCLOSURE

In one aspect, there is provided an elastic ring-based ornament making device for constructing an elastic ring-based ornament that includes at least one elastic ring and a plurality of ornamental members positioned thereon. The elastic ring-based ornament making device includes an elastic ring support including a plurality of extension arms which are movable between a retracted position and an extended position. When the extension arms are in the retracted position, the elastic ring support supports the at least one elastic ring in a first state for the at least one elastic ring. When the extension arms are in the extended position, the elastic ring support supports the at least one elastic ring in a second state for the at least one elastic ring, wherein the at least one elastic ring is stretched more in the second state than in the first state, and wherein the plurality of extension arms in the extended position are spaced from one another sufficiently to permit mounting of the plurality of ornamental members on the at least one elastic ring between the plurality of extension arms.

In another aspect, there is provided a kit of parts for constructing an elastic ring-based ornament. The kit of parts includes at least one elastic ring, a plurality of ornamental members, and an elastic ring-based ornament making device. The elastic ring-based ornament making device includes an elastic ring support including a plurality of extension arms which are movable between a retracted position and an extended position. When the extension arms are in the retracted position, the elastic ring support supports the at least one elastic ring in a first state for the at least one elastic ring. When the extension arms are in the extended position, the elastic ring support supports the at least one elastic ring in a second state for the at least one elastic ring. The at least one elastic ring is stretched more in the second state than in the first state. The plurality of extension arms in the extended position are spaced from one another sufficiently to permit mounting of the plurality of ornamental members on the at least one elastic ring between the plurality of extension arms.

In yet another aspect, there is provided a plurality of ornamental members for mounting to a first elastic ring and a second elastic ring. Each of the ornamental members includes an ornamental member body, a first ring holder and a second ring holder. The first ring holder defines a first ring pass-through aperture sized for holding the first elastic ring, and a first passageway to the first ring pass-through aperture. The first passageway includes a first restriction having a spacing that is smaller than a minimum neutral cross-sectional dimension of the first elastic ring. The second ring holder defines a second ring pass-through aperture sized for holding the second elastic ring, and a second passageway to the second ring pass-through aperture. The second passageway includes a second restriction having a spacing that is smaller than a minimum neutral cross-sectional dimension of the second elastic ring. The first and second passageways are oriented so as to prevent a compressive force on the first and second elastic rings in a direction directly towards one another from urging the first and second elastic rings towards the first and second passageways.

Other technical advantages may become readily apparent to one of ordinary skill in the art after review of the following figures and description.

BRIEF DESCRIPTIONS OF THE DRAWINGS

For a better understanding of the embodiment(s) described herein and to show more clearly how the embodiment(s) may be carried into effect, reference will now be made, by way of example only, to the accompanying drawings.

Figure 1:
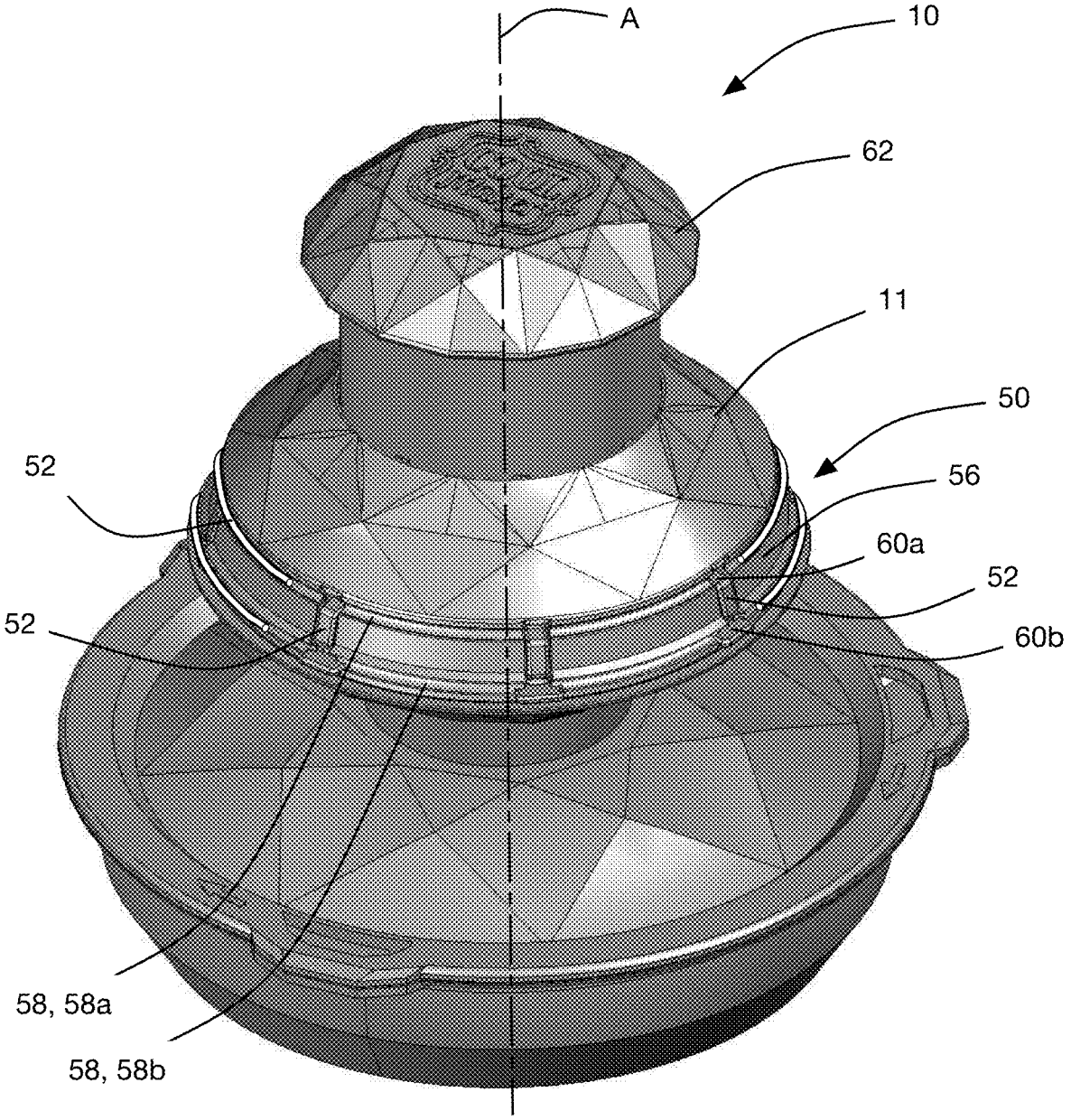
FIG. 1 shows a perspective view of an elastic ring-based ornament making device in accordance with an embodiment of the present disclosure in a first state.

Unless otherwise specifically noted, articles depicted in the drawings are not necessarily drawn to scale.

DETAILED DESCRIPTION

For simplicity and clarity of illustration, where considered appropriate, reference numerals may be repeated among the Figures to indicate corresponding or analogous elements. In addition, numerous specific details are set forth in order to provide a thorough understanding of the embodiment or embodiments described herein. However, it will be understood by those of ordinary skill in the art that the embodiments described herein may be practiced without these specific details. In other instances, well-known methods, procedures and components have not been described in detail so as not to obscure the embodiments described herein. It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description. Furthermore, the use of the term "a" or "an" will be understood to denote "at least one" in all instances unless explicitly stated otherwise or unless it would be understood to be obvious that it must mean "one".

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

Figure 2:
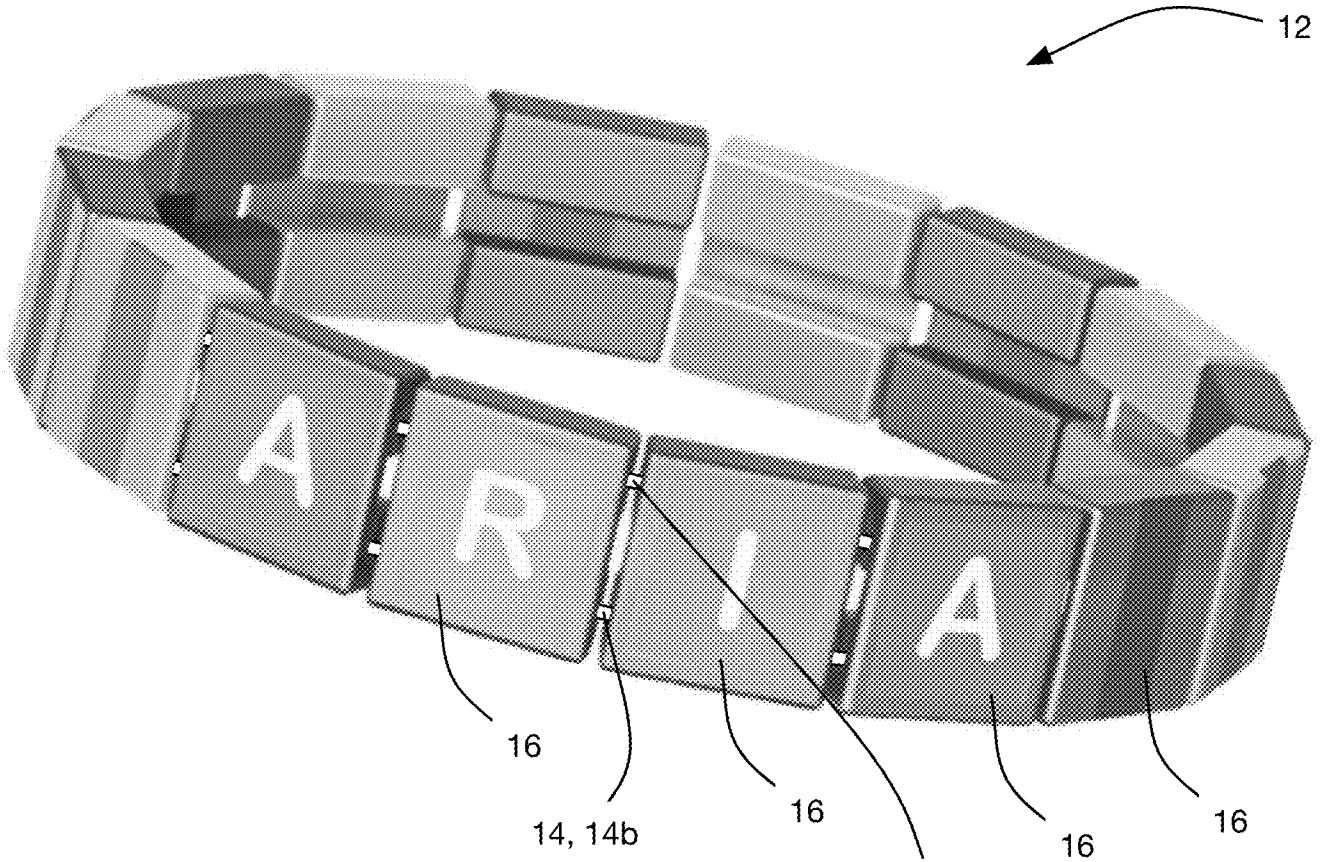
FIG. 2 shows a perspective view of an elastic ring-based ornament that can be made with the elastic ring-based ornament making device shown in FIG. 1.
Figure 3:
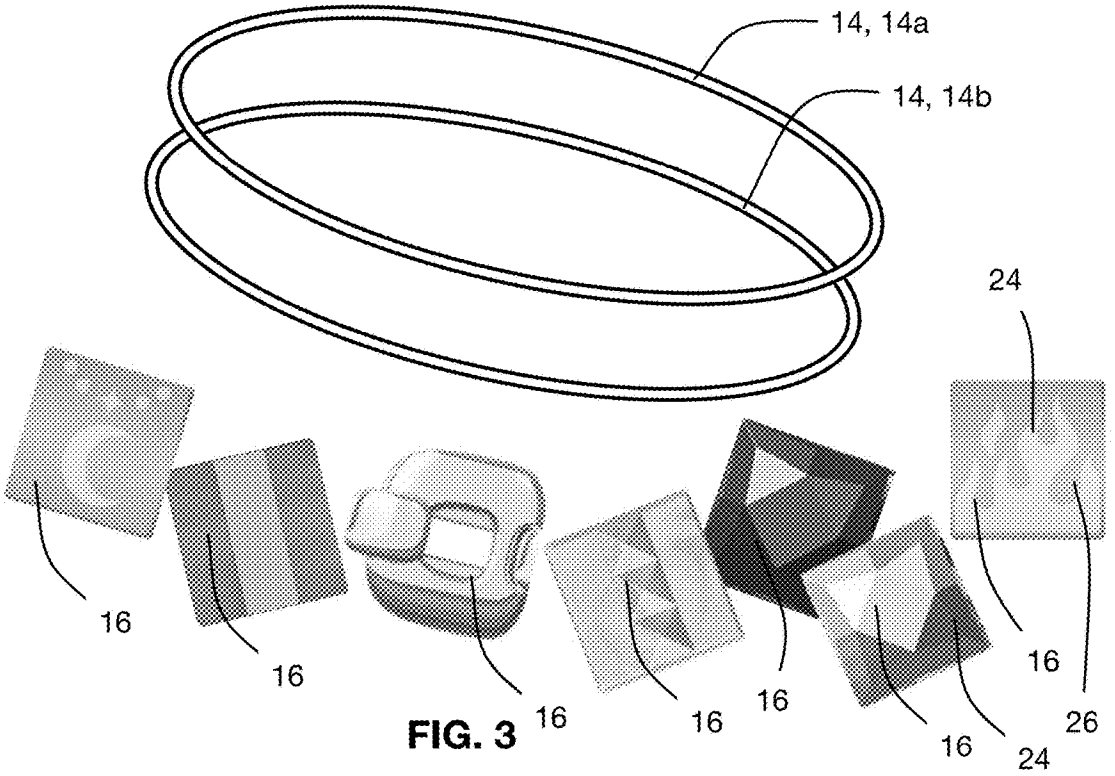
FIG. 3 shows a perspective view of components of the elastic ring-based ornament shown in FIG. 2, including a plurality of elastic rings and a plurality of ornamental members.

Reference is made to FIG. 1, which shows an elastic ring-based ornament making device 10 in accordance with an embodiment of the present disclosure. The elastic ring-based ornament making device 10 is used for constructing an elastic ring-based ornament 12 shown in FIG. 2. The elastic ring-based ornament 12 includes at least one elastic ring 14 as shown in FIG. 3. In the example shown in FIG. 3, the at least one elastic ring 14 includes a first elastic ring 14*a* and a second elastic ring 14*b*. Additionally, the elastic ring-based ornament 12 further includes a plurality of ornamental members 16 which are positioned on the at least one elastic ring 14.

Figure 4:
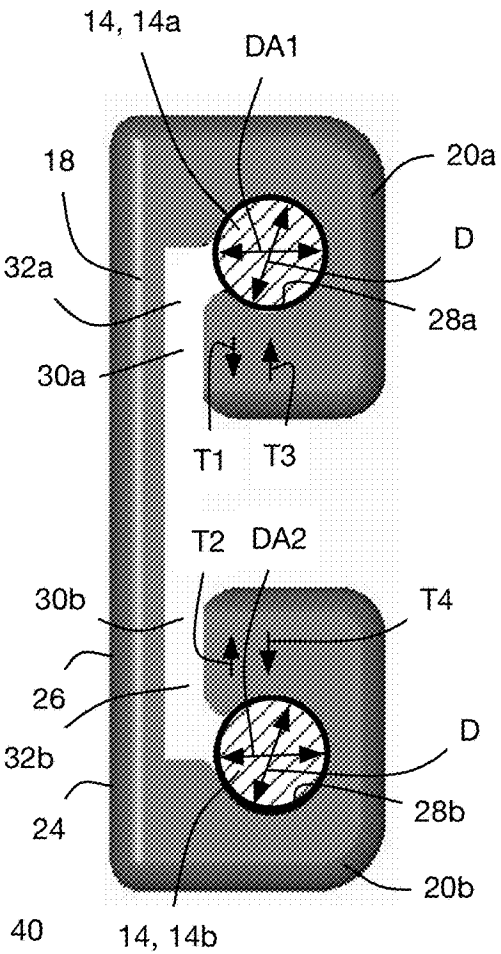
FIG. 4 is a side elevation view of one of the ornamental members shown in FIG. 3.

FIG. 4 shows one of the ornamental members 16 in more detail and shows how it is positioned on the first and second elastic rings 14*a* and 14*b*. Each of the ornamental members 16 includes an ornamental member body 18, a first ring holder 20*a*, and a second ring holder 20*b*. The ornamental member body 18 has an ornamental feature 24. The ornamental feature 24 may be any one or more of: an image on an outer face 26 of the ornamental member 16, a three-dimensional shape that is part of the outer face 26 of the ornamental member body 18, a colour of the outer face 26 of the ornamental member body 18, and a groove in the outer face 26 of the ornamental member body 18, or any other feature of the outer face 26.

Each elastic ring 14 may have a neutral length L (FIG. 3), which is the length of the elastic ring 14 when it is in its neutral (i.e. unstretched) position. Each elastic ring 14 further has a minimum neutral cross-sectional dimension D. The minimum neutral cross-sectional dimension D is the shortest dimension across the cross-section of the elastic ring 14, when it is in its neutral position. Each elastic ring 14 may have any suitable cross-sectional shape. In the embodiment shown, the elastic rings have a circular cross-sectional shape. Accordingly, the minimum neutral cross-sectional dimension D is the same value in all directions through the cross-section.

As further shown in FIG. 4, the first ring holder 20*a* of the ornamental member 16 defines a first ring pass-through aperture 28*a* sized for holding the first elastic ring 14*a*, and a first passageway 30*a* to the first ring pass-through aperture 28*a*. The first passageway 30*a* includes a first restriction 32*a* that has a spacing that is smaller than the minimum neutral cross-sectional dimension D of the first elastic ring 14*a*. In some embodiments, the first restriction 32*a* extends along the entire length of the first passageway 30*a* (as shown in FIG. 4). Thus, in the embodiment shown in FIG. 4, the entire length of the first passageway 30*a* constitutes the first restriction 32*a*, since the entire length of the first passageway 30*a* has a spacing that is smaller than the minimum neutral cross-sectional dimension D of the first elastic ring 14*a*. In other embodiments, the first restriction 32*a* extends only along a portion of the length of the first passageway 30*a*.

As further shown in FIG. 4, the second ring holder 20*b* of the ornamental member 16 defines a second ring pass-through aperture 28*b* sized for holding the second elastic ring 14*b*, and a second passageway 30*b* to the second ring pass-through aperture 28*b*. The second passageway 30*b* includes a second restriction 32*b* that has a spacing that is smaller than the minimum neutral cross-sectional dimension D of the second elastic ring 14*b*. In some embodiments, the second restriction 32*b* extends along the entire length of the second passageway 30*b* (as shown in FIG. 4). Thus, in the embodiment shown in FIG. 4, the entire length of the second passageway 30*b* constitutes the second restriction 32*b*, since the entire length of the second passageway 30*b* has a spacing that is smaller than the minimum neutral cross-sectional dimension D of the second elastic ring 14*b*. In other embodiments, the second restriction 32*b* extends only along a portion of the length of the second passageway 30*b*.

In some embodiments (as shown in FIG. 4), the spacing of the first restriction 32*a* is smaller than the minimum cross-sectional dimension DA1 of the first ring pass-through aperture 28*a*, and the spacing of the second restriction 32*b* is smaller than the minimum cross-sectional dimension DA2 of the second ring pass-through aperture 28*b*. Because the embodiment shown provides the first and second ring pass-through apertures 28*a* and 28*b* each with a circular cross-sectional shape, the minimum cross-sectional dimensions DA1 and DA2 may extend in any orientation, similar to the minimum neutral cross-sectional dimension D for the first and second elastic rings 14*a* and 14*b*. It will be understood that other shapes are possible for the first and second ring pass-through apertures 28*a* and 28*b*, other than circular.

In the embodiment shown, the first and second ring pass-through apertures 28*a* and 28*b* have a size that snuggly fits the first and second elastic rings 14*a* and 14*b*, but permits the first and second elastic rings 14*a* and 14*b* without compressing the first and second elastic rings 14*a* and 14*b*. In other embodiments, however, it is possible to size the first and second ring pass-through apertures 28*a* and 28*b* to compress the first and second elastic rings 28*a* and 28*b* by some amount, so as to help retain the ornamental member in a fixed position on the first and second elastic rings 14*a* and 14*b*.

As can be seen in FIG. 4, the first and second passageways 30*a* and 30*b* are oriented so as to prevent a compressive force on the first and second elastic rings 14*a* and 14*b* in a direction directly towards one another (as represented by direction arrows T1 and T2) from urging the first and second elastic rings 14*a* and 14*b* towards the first and second passageways 30*a* and 30*b*. In the embodiment shown in FIG. 4, this is achieved by orienting the outlets of the first and second passageways 30*a* and 30*b* (wherein the outlets are the ends of the first and second passageways 30*a* and 30*b* that open into the first and second ring pass-through aperture 28*a* and 28*b*, respectively) to be at an angle of about 70 degrees relative to the direction arrows T1 and T2, respectively.

As can also be seen in FIG. 4, the first and second passageways 30*a* and 30*b* are oriented so as to prevent a spreading force on the first and second elastic rings 14*a* and 14*b* in a direction directly away from one another (as represented by direction arrows T3 and T4) from urging the first and second elastic rings 14*a* and 14*b* towards the first and second passageways 30*a* and 30*b*. In the embodiment shown in FIG. 4, this is achieved by orienting the outlets of the first and second passageways 30*a* and 30*b* to be at an angle of about 110 degrees relative to the direction arrows T3 and T4, respectively.

It will be noted that it is possible to have an embodiment in which only a first elastic ring 14*a* is provided, and wherein the ornamental members 16 each only include a first ring pass-through aperture 28*a*.

Figure 5:
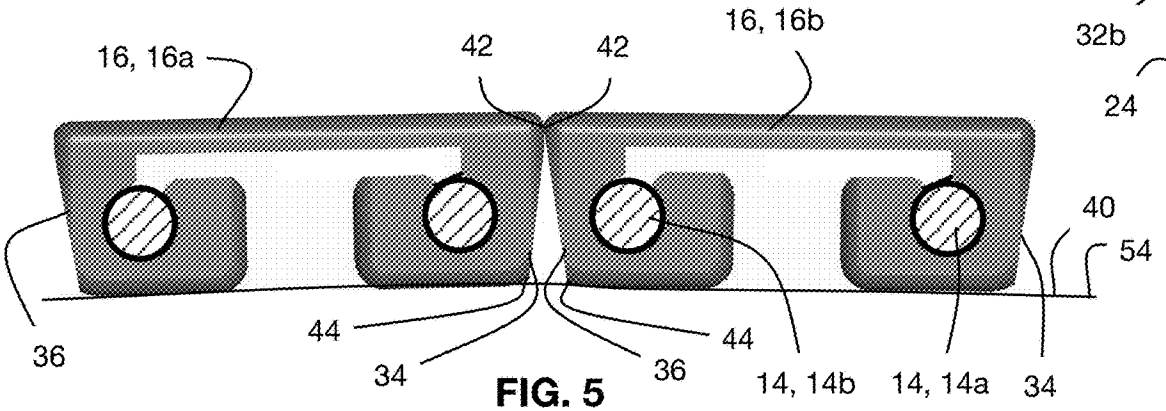
FIG. 5 is a side elevation view of two of the ornamental members shown in FIG. 3, with an optional feature.

Reference is made to FIG. 5, which shows an optional feature for the ornamental members 16. In some embodiments, each of the plurality of ornamental members 16 has a first edge face 34 and a second edge face 36. The first edge face 34 of a first one of the plurality of ornamental members 16 (shown at 16*a*) engages with the second edge face 36 of a second one of the plurality of ornamental members 16 (shown at 16*b*), when positioned adjacent one another on the elastic rings 14. Each of the plurality of ornamental members 16 has a proximal face 38 that is positioned to engage a wrist of a wearer (shown at 40). Each of the first and second edge faces 34 and 36 has a distal end 42 and a proximal end 44, and are shaped such that, in use, when mounted to the at least one elastic ring 14 to form an elastic ring-based ornament 12 and the elastic ring-based ornament 12 is worn on the wrist 40 of the wearer, the distal end 42 of the first edge face 34 of the first one 16*a* of the ornamental members 16 is engaged with the distal end 42 of the second edge face 36 of the second one 16*b* of the ornamental members 16, and the proximal end 44 of the first edge face 34 of the first one 16*a* of the ornamental members 16 is spaced from the proximal end 44 of the second edge face 36 of the second one 16*b* of the ornamental members 16.

Forming the ornamental members 16 to have first and second edge faces 34 and 36 that cooperate as explained above, inhibits pinching of hairs or skin of the wearer.

Figure 6:
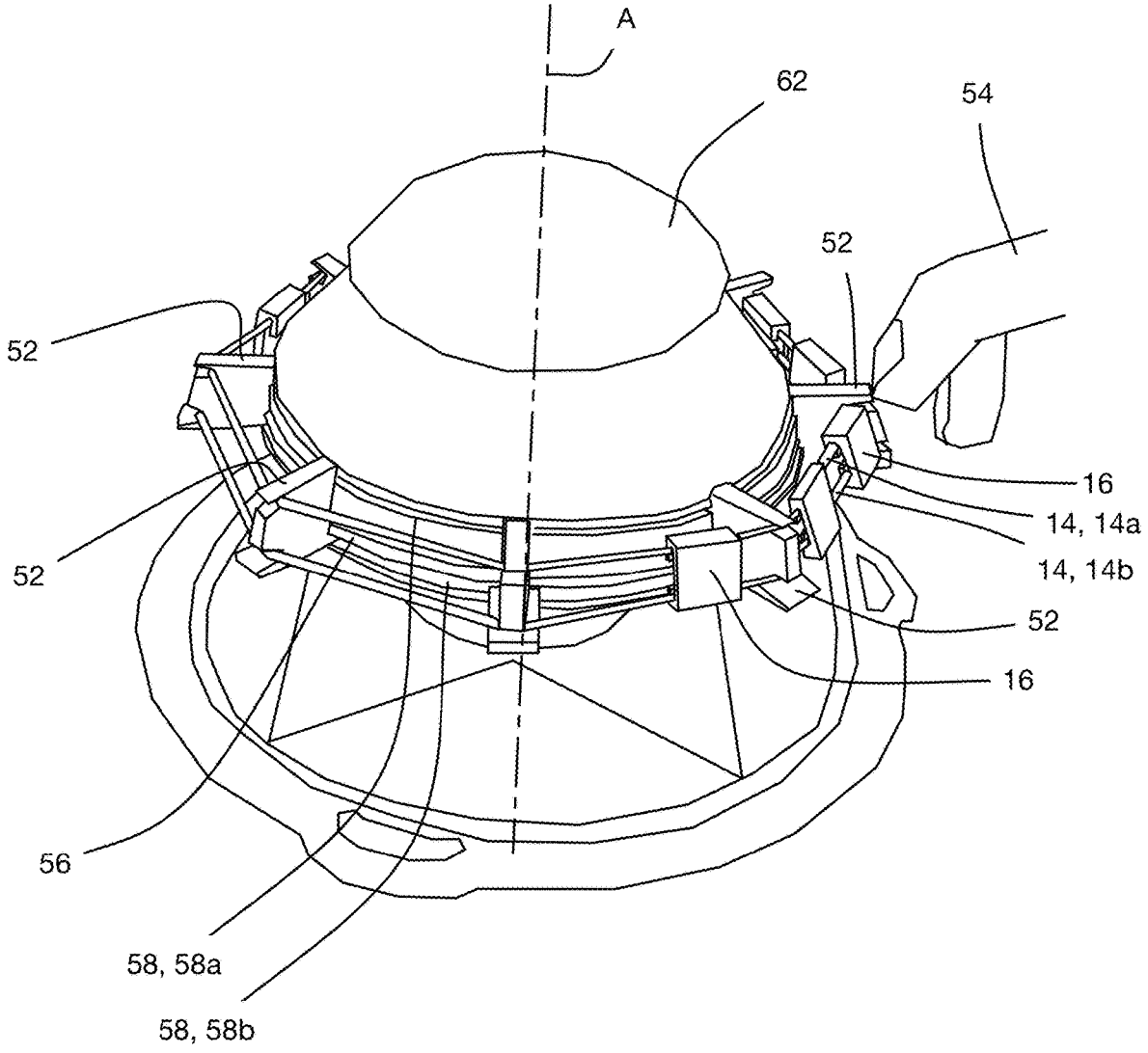
FIG. 6 is a perspective of the elastic ring-based ornament making device shown in FIG. 1 in a second state.

With reference to FIGS. 1 and 6, the elastic ring-based ornament making device 10 is described in further detail. The elastic ring-based ornament making device 10 includes an elastic ring support 50 including a plurality of extension arms 52. The extension arms 52 are movable between a retracted position (FIG. 1) and an extended position (FIG. 6). When the extension arms 52 are in the retracted position, the elastic ring support 50 supports the at least one elastic ring 14 in a first state for the at least one elastic ring 14. The first elastic ring 14*a* and of the second elastic ring 14*b* are shown in cutaway, supported on the elastic ring support 50 in FIG. 1, so as not to obscure selected components thereof.

When the extension arms 52 are in the extended position, the elastic ring support 50 supports the at least one elastic ring 14 in a second state for the at least one elastic ring 14. The at least one elastic ring 14 is stretched more in the second state than in the first state. By placing the at least one elastic ring 14 in the second state, a user (shown at 54) can more easily install ornamental members 16 on the at least one elastic ring 14. The plurality of extension arms 52 in the extended position are spaced from one another sufficiently to permit mounting of the plurality of ornamental members on the at least one elastic ring between the plurality of extension arms 52. In the embodiment shown in FIG. 6, the user 54 is mounting two ornamental members 16 between each pair of adjacent ones of the extension arms 52. However, as few as one ornamental member 16 may be mounted on the at least one elastic ring 14 between each pair of adjacent ones of the extension arms 52, or three or more of the ornamental member 16 may be mounted on the at least one elastic ring 14 between each pair of adjacent ones of the extension arms 52.

The elastic ring support 50 may include a support wall 56 that includes at least one wall groove 58 for holding the at least one elastic ring 14. In the embodiment shown, there is a first wall groove 58*a* and a second wall groove 58*b* for holding the first elastic ring 14*a* and the second elastic ring 14*b*, respectively. When the plurality of extension arms 52 are in the retracted position, the at least one wall groove 58 is positioned to support the at least one elastic ring 14, and when the extension arms 52 are in the extended position, the plurality of extension arms 52 are positioned to hold the at least one elastic ring 14 away from the at least one wall groove 58. The plurality of arms 52 may each have a first arm groove 60*a* positioned for holding the first elastic ring 14*a* and a second arm groove 60*b* positioned for holding the second elastic ring 14*b*. The first and second arm grooves 60*a* and 60*b* inhibit movement of the first and second elastic rings 14*a* and 14*b* towards one another.

As can be seen in FIG. 6, the first and second arm grooves 60*a* and 60*b* are positioned to hold the first and second elastic rings 14*a* and 14*b* as a selected spacing from one another so as to fit into the first and second ring pass-through apertures 28*a* and 28*b*, respectively, of each of the ornamental members 16.

The plurality of extension arms 52 and the mechanism by which the plurality of extension arms 52 are moved between the retracted and extended positions is described below. The plurality of extension arms 52 may be movable from the retracted position to the extended position radially away from a device axis A.

Figure 7:
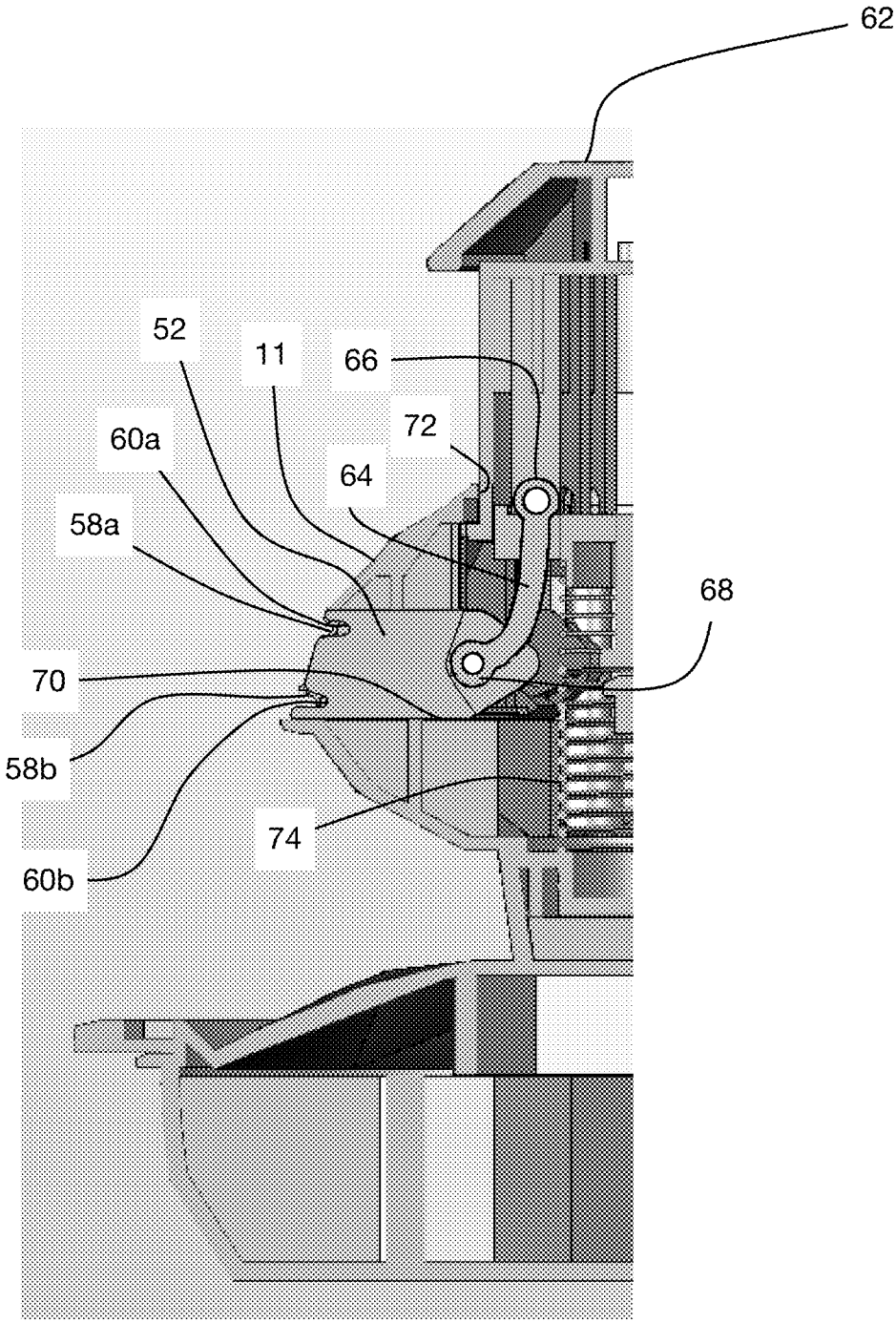
FIG. 7 is a sectional side elevation view of a portion of the elastic ring-based ornament making device shown in FIG. 1, in the first state.
Figure 8:
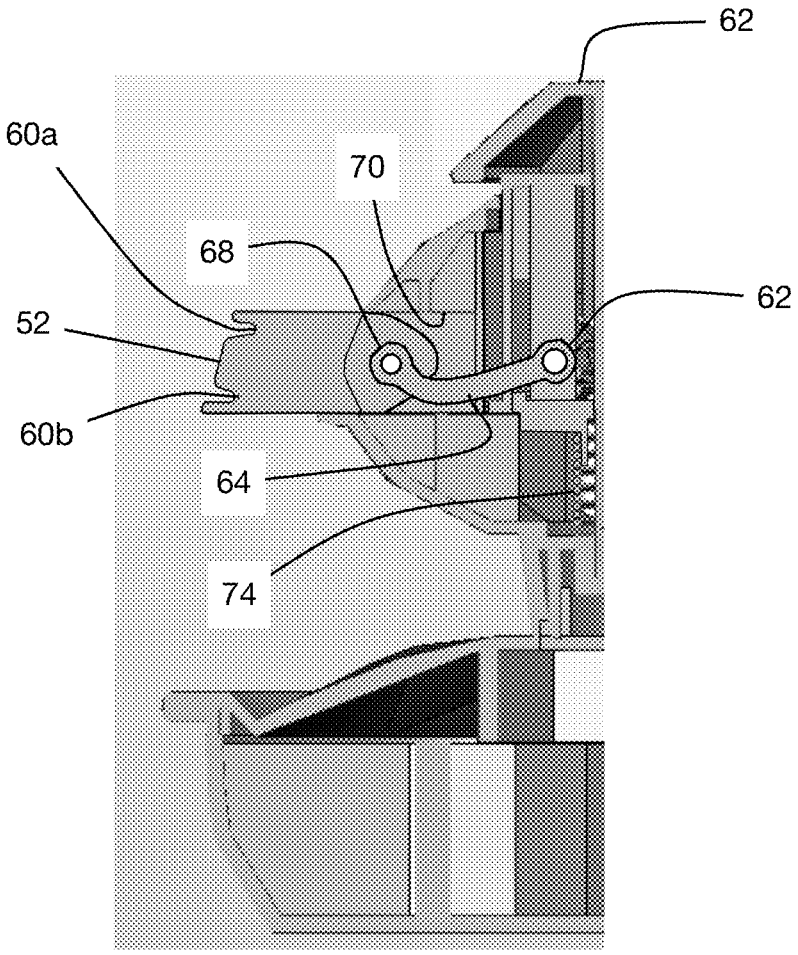
FIG. 8 is a sectional side elevation view of a portion of the elastic ring-based ornament making device shown in FIG. 1, in the second state.

As shown in FIGS. 1, 6, 7 and 8, the elastic ring-based ornament making device 10 includes an arm driver button 62 that is movable between an arm extending button position (FIGS. 6 and 8) and an arm retracting button position (FIGS. 1 and 7). The arm driver button 62 is operatively connected to the plurality of extension arms 52, such that movement of the arm driver button 62 to the arm extending button position drives movement of the plurality of extension arms 52 to the extended position (FIG. 6), and movement of the arm driver button 62 to the arm retracting button position drives movement of the plurality of extension arms 52 to the retracted position. The arm driver button 62 may be operatively connected to each of the plurality of extension arms 52 by a link 64. The link 64 may have a first end 66 that is pivotally connected to the arm driver button 62 and a second end 68 that is pivotally connected to the one of the extension arms 52. The extension arms 52 are constrained to slide in arm guide apertures 70. The arm driver button 62 is constrained to slide in a button guide aperture 72.

An arm driver button biasing member 74 may be provided, that urges the arm driver button 62 to one of the arm extending button position and the arm retracting button position. In the example shown, the arm driver button biasing member 74 urges the arm driver button 62 to the arm retracting button position. The arm driver button biasing member 74 may be any suitable type of biasing member, such as, for example, a helical compression spring, as shown, or any other suitable type of spring.

Figure 9:
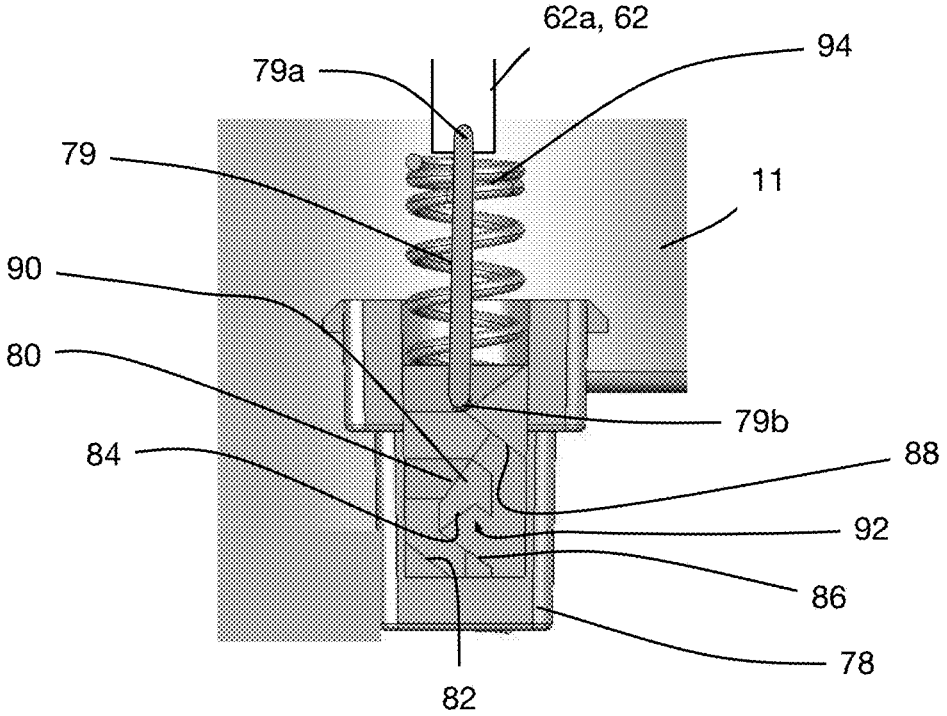
FIG. 9 is a side elevation view of a button lock in a first state, which is used for holding the elastic ring-based ornament making device in the first state.
Figure 10:
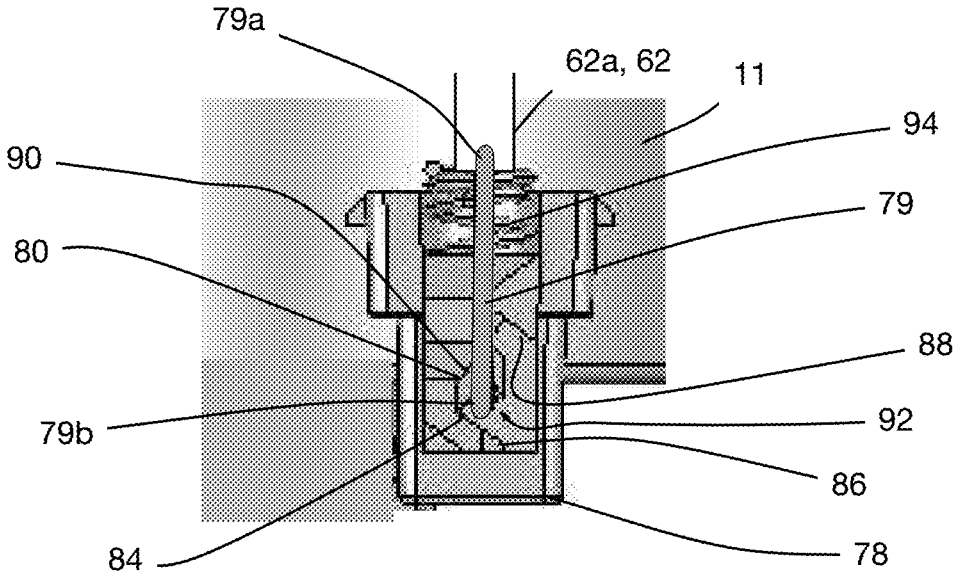
FIG. 10 is a side elevation view of a button lock in a second state, which is used for holding the elastic ring-based ornament making device in the second state.

A button lock may be provided and is shown at 76 in FIGS. 9 and 10. The button lock 76 is positionable in a first button lock position (FIG. 9) by movement of the arm driver button 62 to the said one of the arm extending and arm retracting button positions, and is positionable in a second button lock position (FIG. 10) by movement of the arm driver button 62 to the other of the arm extending and arm retracting button positions.

When in the first button lock position, the button lock 76 permits the arm driver button biasing member 74 to drive the arm driver button 62 to the said one of the arm extending button position and the arm retracting button position. In the example shown, when in the first button lock position, the button lock 76 permits the arm driver button biasing member 74 to drive the arm driver button 62 to the arm retracting button position.

When in the second button lock position, the button lock 76 holds the arm driver button 62 in the other of the arm extending and arm retracting button positions. In the example shown, when in the second button lock position, the button lock holds the arm driver button 62 in the other of the arm extending position.

The button lock 76 may have any suitable structure. For example, the button lock 76 may include a barrier 78, and a barrier holder 79. The barrier 78 is connected to one of the arm driver button 62 and the housing 11 for the elastic ring-based ornament making device 10, and the barrier holder 79 is connected to the other of the arm driver button 62 and the housing 11 for the elastic ring-based ornament making device 10. In the example shown, the barrier holder 79 is connected to the arm driver button 62 (e.g. to a vertically extending projection 62*a* that is part of the arm driver button 62), and the barrier 78 is connected to the housing 11.

In the example, shown, the barrier holder 79 is a relatively rigid member that is frictionally pivotally held at a mounting end 79*a* in the arm driver button 62 (e.g. in the vertically extending projection 62*a*). The barrier holder 79 may be made from a resilient wire and further includes has an engagement end 79*b* extends inwardly into the page in the views shown in FIGS. 9 and 10, though it is somewhat obscured by the rest of the barrier holder 79 itself. The engagement end 79*b* is shown in FIGS. 9 and 10 in a neutral position and can resiliently be moved left or right from this position (in the views shown in FIGS. 9 and 10).

The barrier 78 itself includes several (e.g. first, second, third, fourth and fifth) barrier holder guide surfaces shown at 80, 82, 84, 86, and 88. When the arm driver button 62 is in the arm retracting position and the button lock 76 is in the first button lock position (FIG. 9), and the arm driver button 62 is then pushed in a first direction (e.g. downwards in the view shown in FIG. 9), towards the arm extending position), it will drive the barrier holder 79 into engagement with a first barrier holder guide surface 80, which is on a locking projection 90, which will drive the engagement end 79*b* of the barrier holder 79 towards the left in the view shown in FIG. 9. In the example shown, the engagement of the engagement end 79*b* with the first barrier holder guide surface 80 will cause movement of the engagement end 79*b* towards the left which is achieved because the mounting end 79*a* is pivoted so as to accommodate the leftward movement of the engagement end 79*b*. Further movement of the arm driver button 62 and the barrier holder 79 in the first direction will then bring the engagement end 79*b* around the locking projection 90. Further movement of the barrier holder 79 in the first direction will bring the engagement end 79*b* into engagement with the second barrier holder guide surface 82, which urges the engagement end 79*b* back towards the neutral position. Releasing the arm driver button 62 at this point, permits the arm driver button biasing member 74 to drive the arm driver button 62 in a second direction opposite the first direction (i.e. upwards) and permits an optionally provided barrier holder biasing member 94 to urge the barrier holder 79 in the second direction. This brings the engagement end 79*b* into engagement with the third barrier holder guide surface 84. Further movement of the arm driver button 62 and the barrier holder 79 in the second direction brings the engagement end 79*b* into engagement with a locking notch shown at 92 (i.e. the position shown in FIG. 10), at which point the arm driver button 62 is in the arm extending position and the button lock 76 is in the second button lock position.

When the button lock 76 is in the second button lock position as shown in FIG. 10, and the arm driver button 62 is pushed in the first direction again (i.e. downwards in the view shown in FIG. 10), the barrier holder 79 (i.e. the engagement end 79*b* thereof) is brought into engagement with the fourth barrier holder guide surface 86, which guides the engagement end 79*b* over to the right of the locking projection 90. Release of the arm driver button 62 and therefore of the barrier holder 79 at this point, then permits the arm driver button biasing member 74 and the optionally provided barrier biasing member 94 to drive the arm driver button 62 and the barrier holder 79 in the second direction (i.e. upward in the view shown), at which point the engagement end 79*b* passes around the right side of the locking projection 90, and engages the fifth barrier holder guide surface 88, which guides the engagement end 79*b* back towards the neutral position shown in both FIGS. 9 and 10 (i.e. a generally centered position).

Optionally, a kit of parts may be provided, in which the elastic ring-based ornament making device 10, the at least one elastic ring 14 and the plurality of ornamental members 16 are all included, and sold to a user, such as the user 54.

Although specific advantages have been enumerated above, various embodiments may include some, none, or all of the enumerated advantages.

Persons skilled in the art will appreciate that there are yet more alternative implementations and modifications possible, and that the above examples are only illustrations of one or more implementations. The scope, therefore, is only to be limited by the claims appended hereto and any amendments made thereto.

What is claimed is:

1. An elastic ring-based ornament making device for constructing an elastic ring-based ornament that includes at least one elastic ring and a plurality of ornamental members positioned thereon, the elastic ring-based ornament making device comprising:

an elastic ring support including a plurality of extension arms which are movable between a retracted position and an extended position, wherein, when the extension arms are in the retracted position, the elastic ring support supports the at least one elastic ring in a first state for the at least one elastic ring, and, when the extension arms are in the extended position, the elastic ring support supports the at least one elastic ring in a second state for the at least one elastic ring, wherein the at least one elastic ring is stretched more in the second state than in the first state, and wherein the plurality of extension arms in the extended position are spaced from one another sufficiently to permit mounting of the plurality of ornamental members on the at least one elastic ring between the plurality of extension arms, wherein the elastic ring support includes a support wall that includes at least one wall groove for holding the at least one elastic ring, wherein, when the plurality of extension arms are in the retracted position, the at least one wall groove is positioned to support the at least one elastic ring, and when the plurality of extension arms are in the extended position, the plurality of extension arms are positioned to hold the at least one elastic ring away from the at least one wall groove.

2. The elastic ring-based ornament making device as claimed in claim 1, wherein the at least one elastic ring includes a first elastic ring and a second elastic ring, and wherein the at least one wall groove includes a first wall groove positioned for holding the first elastic ring, and a second wall groove positioned for holding the second elastic ring.

3. The elastic ring-based ornament making device as claimed in claim 2, wherein the plurality of extension arms each have a first arm groove positioned for holding the first elastic ring and a second arm groove positioned for holding the second elastic ring, wherein the first and second arm grooves inhibit movement of the first and second elastic rings towards one another.

4. The elastic ring-based ornament making device as claimed in claim 3, wherein each of the plurality of ornamental members includes a first ring pass-through aperture and a second ring pass-through aperture, and wherein the first and second arm grooves are positioned to hold the first and second elastic rings at a selected spacing from one another so as to fit into the first ring pass-through aperture and the second ring pass-through aperture of each of the plurality of ornamental members.

5. The elastic ring-based ornament making device as claimed in claim 1, wherein the plurality of extension arms are movable from the retracted position to the extended position radially away from a device axis.

6. The elastic ring-based ornament making device as claimed in claim 1, further comprising an arm driver button that is movable between an arm extending button position and an arm retracting button position, wherein the arm driver button is operatively connected to the plurality of extension arms, such that movement of the arm driver button to the arm extending button position drives movement of the plurality of extension arms to the extended position, and movement of the arm driver button to the arm retracting button position drives movement of the plurality of extension arms to the retracted position.

7. The elastic ring-based ornament making device as claimed in claim 6, further comprising:

an arm driver button biasing member that urges the arm driver button to one of the arm extending button position and the arm retracting button position; and a button lock that is positionable in a first button lock position by movement of the arm driver button to said one of the arm extending and arm retracting button positions, wherein, when in the first button lock position, the button lock permits the arm driver button biasing member to drive the arm driver button to said one of the arm extending button position and the arm retracting button position, wherein the button lock is positionable in a second button lock position by movement of the arm driver button to the other of the arm extending and arm retracting button positions, and wherein, when in the second button lock position, the button lock holds the arm driver button in the other of the arm extending and arm retracting button positions.

8. A kit of parts for constructing an elastic ring-based ornament, comprising:

at least one elastic ring;

a plurality of ornamental members; and an elastic ring-based ornament making device including an elastic ring support including a plurality of extension arms which are movable between a retracted position and an extended position, wherein, when the extension arms are in the retracted position, the elastic ring support supports the at least one elastic ring in a first state for the at least one elastic ring, and, when the extension arms are in the extended position, the elastic ring support supports the at least one elastic ring in a second state for the at least one elastic ring, wherein the at least one elastic ring is stretched more in the second state than in the first state, and wherein the plurality of extension arms in the extended position are spaced from one another sufficiently to permit mounting of the plurality of ornamental members on the at least one elastic ring between the plurality of extension arms.

9. The kit of parts as claimed in claim 8, wherein the elastic ring support includes a support wall that includes at least one wall groove for holding the at least one elastic ring, wherein, when the plurality of extension arms are in the retracted position, the at least one wall groove is positioned to support the at least one elastic ring, and when the plurality of extension arms are in the extended position, the plurality of extension arms are positioned to hold the at least one elastic ring away from the at least one wall groove.

10. The kit of parts as claimed in claim 9, wherein the at least one elastic ring includes a first elastic ring and a second elastic ring, and wherein the at least one wall groove includes a first wall groove positioned for holding the first elastic ring, and a second wall groove positioned for holding the second elastic ring.

11. The kit of parts as claimed in claim 10, wherein the plurality of extension arms each have a first arm groove positioned for holding the first elastic ring and a second arm groove positioned for holding the second elastic ring, wherein the first and second arm grooves inhibit movement of the first and second elastic rings towards one another.

12. The kit of parts as claimed in claim 11, wherein each of the plurality of ornamental members includes a first ring pass-through aperture and a second ring pass-through aperture, and wherein the first and second arm grooves are positioned to hold the first and second elastic rings at a selected spacing from one another so as to fit into the first ring pass-through aperture and the second ring pass-through aperture of each of the plurality of ornamental members.

13. The kit of parts as claimed in claim 9, further comprising:

an arm driver button biasing member that urges the arm driver button to one of the arm extending button position and the arm retracting button position; and a button lock that is positionable in a first button lock position by movement of the arm driver button to said one of the arm extending and arm retracting button positions, wherein, when in the first button lock position, the button lock permits the arm driver button biasing member to drive the arm driver button to said one of the arm extending button position and the arm retracting button position, wherein the button lock is positionable in a second button lock position by movement of the arm driver button to the other of the arm extending and arm retracting button positions, and wherein, when in the second button lock position, the button lock holds the arm driver button in the other of the arm extending and arm retracting button positions.

14. The kit of parts as claimed in claim 8, wherein the plurality of extension arms are movable from the retracted position to the extended position radially away from a device axis.

15. The kit of parts as claimed in claim 8, further comprising an arm driver button that is movable between an arm extending position and an arm retracting button position, wherein the arm driver button is operatively connected to the plurality of extension arms, such that movement of the arm driver button to the arm extending position drives movement of the plurality of extension arms to the extended position, and movement of the arm driver button to the arm retracting position drives movement of the plurality of extension arms to the retracted position.

16. An elastic ring-based ornament making device for constructing an elastic ring-based ornament that includes at least one elastic ring and a plurality of ornamental members positioned thereon, the elastic ring-based ornament making device comprising:

an elastic ring support including a plurality of extension arms which are movable between a retracted position and an extended position, wherein, when the extension arms are in the retracted position, the elastic ring support supports the at least one elastic ring in a first state for the at least one elastic ring, and, when the extension arms are in the extended position, the elastic ring support supports the at least one elastic ring in a second state for the at least one elastic ring, wherein the at least one elastic ring is stretched more in the second state than in the first state, and wherein the plurality of extension arms in the extended position are spaced from one another sufficiently to permit mounting of the plurality of ornamental members on the at least one elastic ring between the plurality of extension arms;

an arm driver button that is movable between an arm extending button position and an arm retracting button position, wherein the arm driver button is operatively connected to the plurality of extension arms, such that movement of the arm driver button to the arm extending button position drives movement of the plurality of extension arms to the extended position, and movement of the arm driver button to the arm retracting button position drives movement of the plurality of extension arms to the retracted position;

an arm driver button biasing member that urges the arm driver button to one of the arm extending button position and the arm retracting button position; and a button lock that is positionable in a first button lock position by movement of the arm driver button to said one of the arm extending and arm retracting button positions, wherein, when in the first button lock position, the button lock permits the arm driver button biasing member to drive the arm driver button to said one of the arm extending button position and the arm retracting button position, wherein the button lock is positionable in a second button lock position by movement of the arm driver button to the other of the arm extending and arm retracting button positions, and wherein, when in the second button lock position, the button lock holds the arm driver button in the other of the arm extending and arm retracting button positions.

17. The elastic ring-based ornament making device as claimed in claim 16, wherein the elastic ring support includes a support wall that includes at least one wall groove for holding the at least one elastic ring, wherein, when the plurality of extension arms are in the retracted position, the at least one wall groove is positioned to support the at least one elastic ring, and when the plurality of extension arms are in the extended position, the plurality of extension arms are positioned to hold the at least one elastic ring away from the at least one wall groove, wherein the at least one elastic ring includes a first elastic ring and a second elastic ring, and wherein the at least one wall groove includes a first wall groove positioned for holding the first elastic ring, and a second wall groove positioned for holding the second elastic ring.

18. The elastic ring-based ornament making device as claimed in claim 17, wherein the plurality of extension arms each have a first arm groove positioned for holding the first elastic ring and a second arm groove positioned for holding the second elastic ring, wherein the first and second arm grooves inhibit movement of the first and second elastic rings towards one another.

19. The elastic ring-based ornament making device as claimed in claim 18, wherein each of the plurality of ornamental members includes a first ring pass-through aperture and a second ring pass-through aperture, and wherein the first and second arm grooves are positioned to hold the first and second elastic rings at a selected spacing from one another so as to fit into the first ring pass-through aperture and the second ring pass-through aperture of each of the plurality of ornamental members.

20. The elastic ring-based ornament making device as claimed in claim 16, wherein the plurality of extension arms are movable from the retracted position to the extended position radially away from a device axis.

* * * * *